US012644352B2

(12) United States Patent
Knudtzon et al.

(10) Patent No.: US 12,644,352 B2
(45) Date of Patent: Jun. 2, 2026

(54) WELLHEAD ASSEMBLIES AND METHODS

(71) Applicant: OneSubsea AS, Oslo (NO)

(72) Inventors: Christopher Almeland Knudtzon, Tranby (NO); Arild Nor Buset, Stabekk (NO); Martin Pedersen, Tranby (NO)

(73) Assignee: OneSubsea AS, Oslo (NO)

( * ) Notice: Subject to any disclaimer, the term of this patent is extended or adjusted under 35 U.S.C. 154(b) by 0 days.

(21) Appl. No.: 19/077,913

(22) Filed: Mar. 12, 2025

(65) Prior Publication Data

US 2025/0290381 A1 Sep. 18, 2025

(30) Foreign Application Priority Data

Mar. 12, 2024 (GB) ..... 2403579

(51) Int. Cl.
*E21B 33/035* (2006.01)
*E21B 33/14* (2006.01)

(52) U.S. Cl.
CPC ..... *E21B 33/035* (2013.01); *E21B 33/14* (2013.01)

(58) Field of Classification Search
CPC ..... E21B 33/035; E21B 33/14; E21B 41/08; E21B 7/128; E21B 7/20; E21B 33/043; E21B 33/143; E02B 17/00
See application file for complete search history.

(56) References Cited

U.S. PATENT DOCUMENTS 3,189,100 A * 6/1965 Haeber ..... E21B 33/035 166/368
3,424,242 A * 1/1969 Triplett ..... E21B 7/128 166/344
3,633,667 A * 1/1972 Falkner, Jr. ..... E21B 43/017 166/365
4,190,120 A * 2/1980 Regan ..... E21B 41/0014 173/195
4,706,757 A * 11/1987 Harrington ..... E21B 43/017 175/7

FOREIGN PATENT DOCUMENTS

GB 2589076 A * 5/2021 ..... E21B 33/035
WO WO-2018117862 A1 * 6/2018 ..... E02B 17/02
WO WO-2024056661 A1 * 3/2024 ..... E21B 41/08

* cited by examiner

*Primary Examiner* — James G Sayre
(74) *Attorney, Agent, or Firm* — Kyle R. Miiller

(57) ABSTRACT

A wellhead assembly comprises a foundation having at least one well slot. The at least one well slot comprises a receptacle having an internal profile for holding a well pipe and a sleeve arranged in the receptacle. The sleeve is vertically movable and has a top end, which in a first position of the sleeve is located above the internal profile and in a second position of the sleeve is located below the internal profile. There is also provided a method of installing a wellhead assembly at a seabed.

20 Claims, 3 Drawing Sheets

WELLHEAD ASSEMBLIES AND METHODS

CROSS-REFERENCE TO RELATED APPLICATION

This application claims priority to and the benefit of U.K. Patent Application No. 2403579.2, entitled "WELLHEAD ASSEMBLIES AND METHODS," filed Mar. 12, 2024, which is hereby incorporated by reference in its entirety for all purposes.

TECHNICAL FIELD

The present disclosure relates to subsea wellhead assemblies and methods, including but not limited to assemblies and methods for installing well pipes as part of a seabed structure.

BACKGROUND

Wellhead systems for subsea hydrocarbon production, carbon dioxide storage or similar applications are traditionally known to comprise a wellhead having a wellhead housing secured to a well casing extending into the earth towards a hydrocarbon reservoir or other subsurface geological structure. A foundation, such as a frame or a template, is often positioned on the seabed and used to support the wellhead and associated equipment.

Publications which may be useful to understand the present disclosure include EP 3 333 358 A1; WO 2022/265516 A1; U.S. Pat. No. 4,822,212 A; WO 2012/065896 A2; and NO 314320 B1.

During the construction of hydrocarbon wells and the installation of well pipes, it is common to inject cement between the earth formation and the outermost pipe, and in annuli between pipes in the well. During the initial stages of well construction, when the wellbore closest to the seabed is constructed, control of the return cement may pose a challenge, which can lead to increased cement usage, longer operational time, and/or interference with equipment or other operations. It is also desirable to minimise movement of the seabed around the installed foundation during preparation of the wellbore, to avoid interfering with the support of the well and drilling operation.

Due to the high costs of offshore well construction operations, often involving specialised and costly vessels, and the potentially serious consequences of irregularities in the safety-critical components making up the subsea wellhead system, there is a continuous need for improved technology in this area. The present disclosure has the objective to provide such improvements, or at least alternatives to the state of the art.

SUMMARY

In an example, there is provided a wellhead assembly comprising: a foundation having at least one well slot; the at least one well slot comprising a receptacle having an internal profile for holding a well pipe; a sleeve arranged in the receptacle; wherein the sleeve is vertically movable and has a top end which in a first position of the sleeve is located above the internal profile and in a second position of the sleeve is located below the internal profile.

In an example, there is provided a method of installing a wellhead assembly at a seabed, the method comprising: positioning a foundation at the seabed, the foundation having at least one well slot; providing a sleeve; bringing the sleeve into the seabed at the at least one well slot; lowering a well pipe through the sleeve and into the seabed; and cementing the well pipe in place inside the sleeve.

Various further embodiments and examples are outlined in the detailed description and claims below, and in the appended drawings.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness. These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
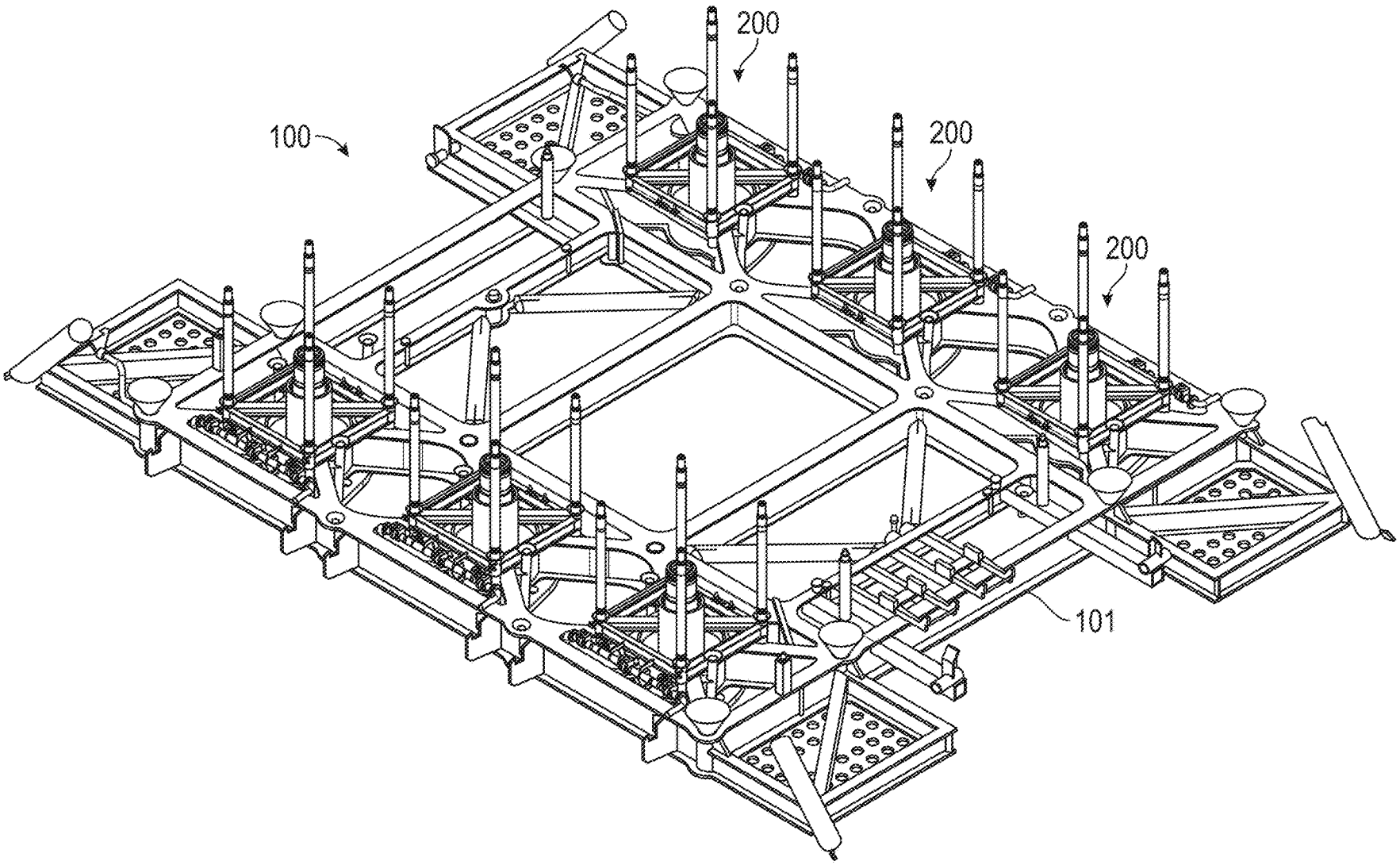
FIG. 1 illustrates a subsea wellhead assembly.

One or more specific embodiments of the present disclosure will be described below. The particulars shown herein are by way of example, and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure, the description taken with the drawings making apparent to those skilled in the art how the several forms of the subject disclosure may be embodied in practice. Additionally, to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are used in an open-ended fashion, and thus should be interpreted to mean "including, but not limited to." Also, any use of any form of the terms "connect," "engage," "couple," "attach," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

FIG. 1 illustrates a wellhead assembly 100 for a subsea field. A foundation 101, such as a frame or a template, has at least one well slot 200 for supporting a wellhead and associated equipment. In the illustrated example, the foundation 101 has six well slots 200 defined by a horizontal beam structure making up the foundation 101, but the foundation 101 may have fewer than six or more than six well slots 200. The foundation 101 may optionally be of a different type, such as a single-well suction anchor foundation.

Figure 2:
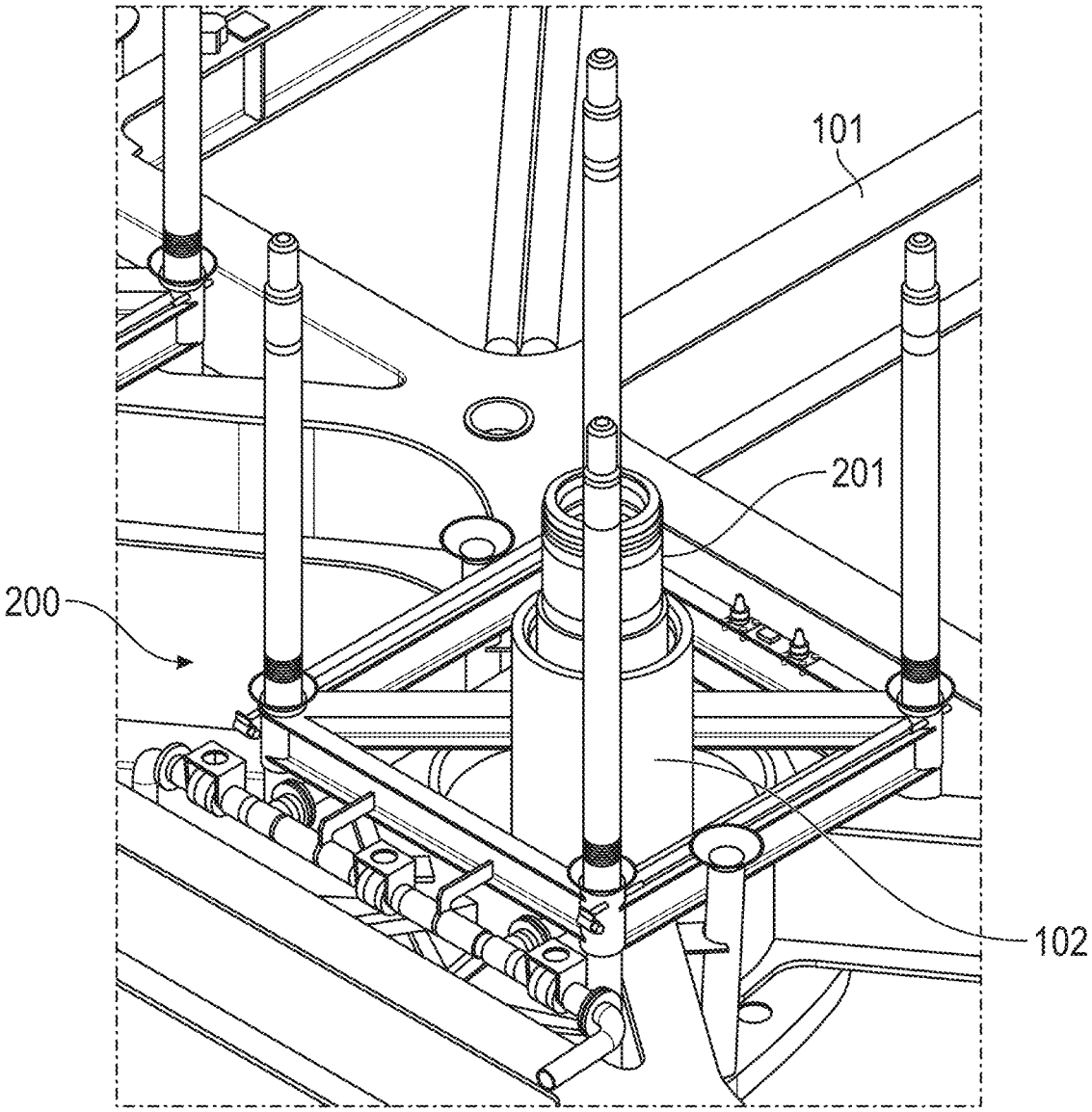
FIG. 2 illustrates details of the subsea wellhead assembly, hereunder a receptacle holding a wellhead housing.

Shown in closer detail in FIG. 2, each well slot 200 has a receptacle 102 for holding a well pipe 201. The well pipe 201 may be a low pressure pipe or a high pressure pipe, and may comprise a housing with a pipe connected thereto and which extends downwardly into the earth. In the case of a low pressure pipe, the well pipe housing may be a conductor housing, which itself can be configured to receive and hold a high-pressure housing, which may be a wellhead. The assembly 100 may, when installed, comprise a low pressure pipe (such as a conductor) with a low pressure housing landed and locked in the receptacle 102 and a high pressure pipe with a high pressure housing (such as a wellhead) landed and locked in the low pressure housing. As will be understood by the skilled reader, the terms low pressure and high pressure in this context differentiate between pipes which are configured for holding and handling reservoir and well fluid pressures, and those which are not configured for holding such high internal pressures. Optionally, the well pipe 201 may be a high pressure pipe with a housing arranged directly in the receptacle 102 without a low pressure housing therebetween, for example in a so-called conductorless well arrangement.

Figure 3:
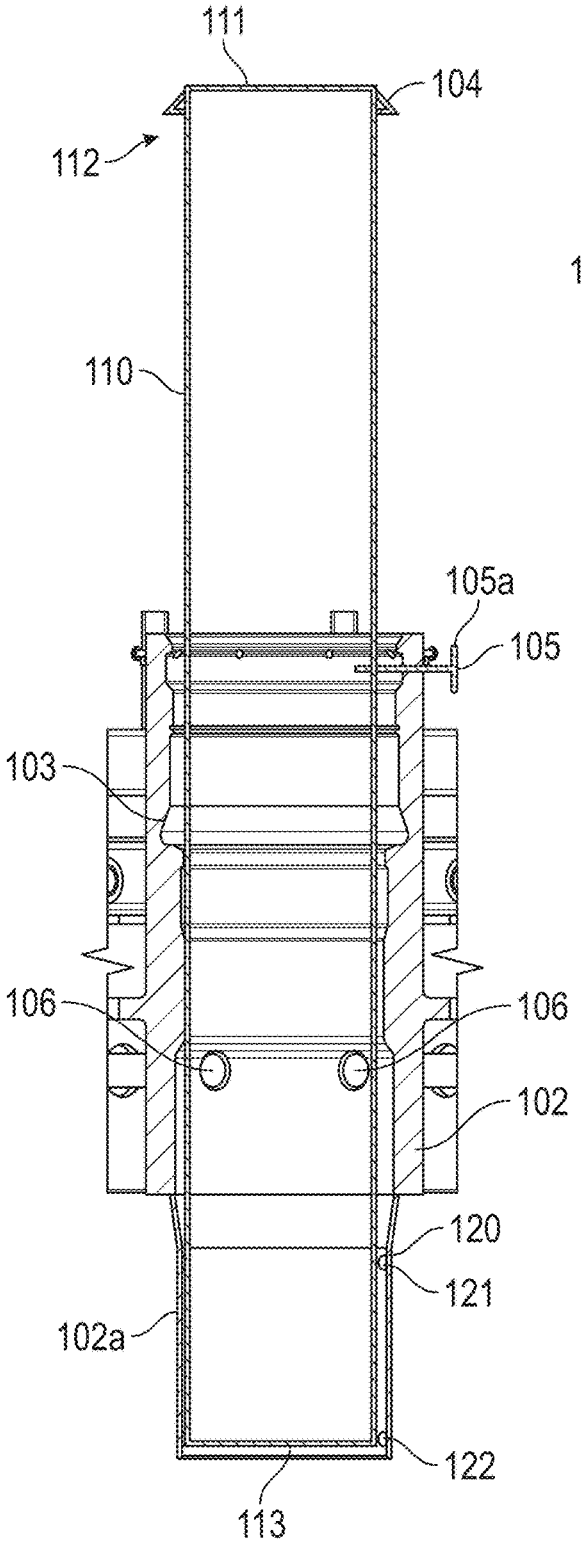
FIGS. 3 and 4 illustrate a receptacle for a wellhead assembly having a sleeve which is movable between two positions.
Figure 4:
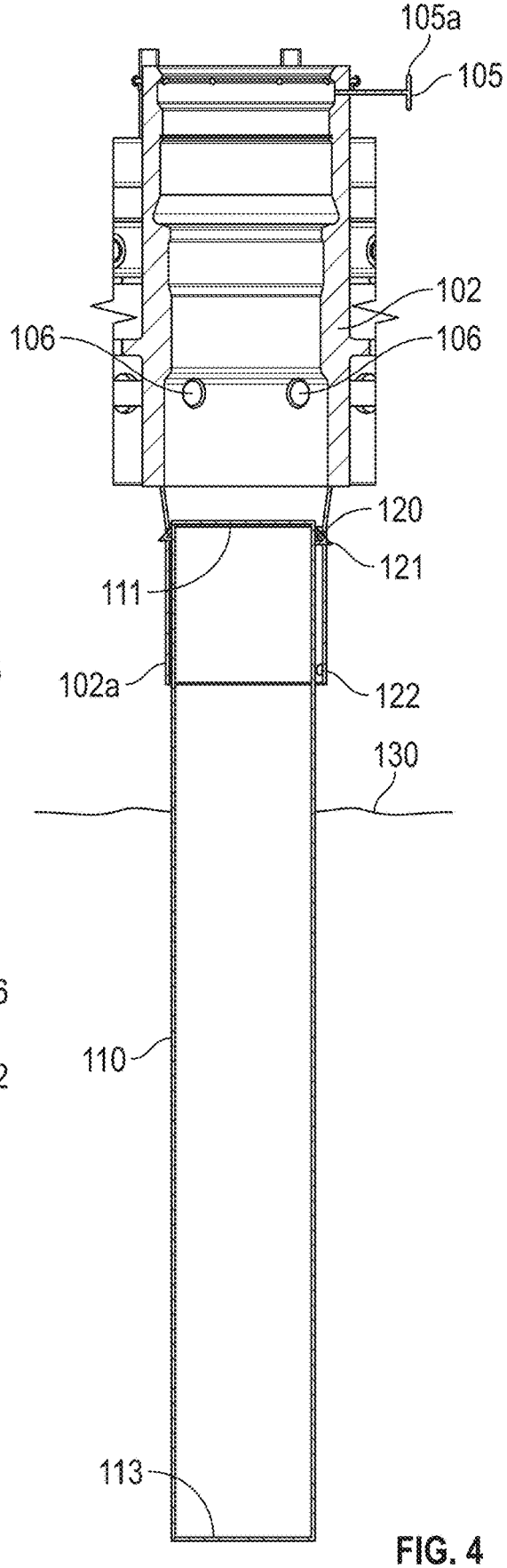

FIGS. 3 and 4 illustrate the receptacle 102 in closer detail, in a cut view. The receptacle 102 has an internal profile 103 configured for receiving and holding the well pipe 201. The internal profile 103 may comprise, for example, shoulders for landing and carrying a weight of the well pipe 201 (and optionally any associated pipes connected to the well pipe 201), lock faces for locking the well pipe 201 in the receptacle 102, seal faces to cooperate with seals between the well pipe 201 and the receptacle 102, etc. The receptacle 102 further has at least one cement port 106.

A movable sleeve 110 is arranged in the receptacle 102. The sleeve 110 may be a tubular member, and may for example be a tail pipe or washout sleeve configured to reduce unwanted cratering or other undesirable interaction with the seabed 130 during construction of a wellbore at the respective well slot 200. The sleeve 110 is movable between a first position, illustrated in FIG. 3, and a second position, illustrated in FIG. 4. In the first position, a top end 111 of the sleeve 110 is located above the internal profile 103 and in the second position the top end 111 is located below the internal profile 103.

In the first position, as illustrated in FIG. 3, a bottom end 113 of the sleeve 110 may be located inside the receptacle 102, i.e. above a lowermost end of the receptacle 102. Alternatively, the bottom end 113 may be below the receptacle 102 but above the seabed 130. The receptacle 102 may be held above a seabed 130 (see FIG. 4) by the foundation 101.

The sleeve 110 may have a length which is greater than a length of the receptacle 102, and the sleeve 110 may extend upwardly out of the receptacle 102 in the first position, as illustrated in FIG. 3.

In the second position, as illustrated in FIG. 4, the sleeve 110 extends from the receptacle 102 and into the seabed 130, while still being (directly or indirectly) connected to the receptacle 102. In the second position, the top end 111 may be located below the at least one cement port 106 of the receptacle 102. The top end 111 may in the second position be located inside the receptacle 102 or inside a vertical downwardly extension 102*a* of the receptacle 102, which for the purposes of this disclosure is considered part of the receptacle 102.

In use, the wellhead assembly 100 can be installed by positioning the foundation 101 at the seabed 130. The receptacle 102 may be a part of the foundation 101 when the foundation 101 is lowered to the seabed 130. The sleeve 110 may also be arranged at and thus installed together with the foundation 101 when the foundation 101 is lowered to the seabed 130. Optionally, the sleeve 110 can be lowered and positioned in the receptacle 102 after the foundation 101 has been placed on the seabed 130, for example via wireline from a surface vessel.

When preparing the top hole, i.e. the uppermost part of the well extending into and directly below the seabed 130, the relevant well construction equipment can be run through the sleeve 110. This may, for example, include jetting equipment or drilling equipment, to prepare the uppermost parts of the well. The sleeve 110 may be arranged to be movable relative to the receptacle 102 while preparing the uppermost parts of the well, such that the sleeve 110 can move into the well as the top hole is being prepared (e.g. by its own gravity or by downforce from the well construction equipment). Alternatively, the sleeve 110 can be driven into the seabed 130, for example by weight, by suitable equipment therefor (e.g. by jarring), or by other means.

The sleeve 110 is moved into the seabed 130 and soil until it reaches the second position, as illustrated in FIG. 4.

The assembly 100 may comprise a sleeve lock mechanism operable to lock the sleeve 110 in the second position, to prevent longitudinal movement of the sleeve 110 relative to the receptacle 102 when the sleeve 110 is in the second position. The sleeve lock mechanism can be arranged to automatically engage and lock the sleeve 110 relative to the receptacle 102 when the sleeve 110 reaches the second position when moved from the first position.

In the schematically illustrated example in FIGS. 3 and 4, the sleeve lock mechanism is a sleeve lock member 104 in the form of a split ring, arranged at a top end part 112 of the sleeve 110, e.g. near or directly below the top end 111. The sleeve lock member 104 is configured to engage a lock face 120, such as a groove or recess, arranged below the internal profile 103 in the receptacle 102. Alternatively, the sleeve lock member, such as a split ring, may be arranged in the receptacle 102, and the lock face, such as a groove or recess, may be arranged at the top end part 112 of the sleeve 110.

The lock member and lock face may comprise any other suitable mechanism, such as locking dogs, clamps or the like. The lock mechanism may be self-activating, for example by means of spring preload, when the sleeve 110 reaches the second position. Optionally, the lock mechanism may be operable and engageable from outside the receptacle 102, for example by means of an ROV.

The sleeve 110 can in this manner be locked in place when reaching the second position, as illustrated in FIG. 4.

A vertical lock 105 may be provided, and operable to temporarily hold the sleeve 110 fixed in the first position. This may, for example, be advantageous to ensure that the sleeve 110 remains in the first position and fixed relative to the receptacle 102 during installation of the foundation 101 at the seabed 130.

The vertical lock 105 may have an unlock interface 105*a* via which the vertical lock 105 can be released, such as to release the sleeve 110. The unlock interface 105*a* can, for example, be engageable by an ROV from outside the receptacle 102, by well construction equipment inside the sleeve 110, or by other means. In the illustrated example, the vertical lock 105 is arranged at the receptacle 102 and engaging the sleeve 110. Optionally, the vertical lock 105 can be provided at the sleeve 110, e.g. in the form of a removable lock pin resting against a surface on the receptacle 102, or other mechanisms.

To ensure reliable movement of the sleeve 110 relative to the receptacle 102, two vertically spaced support faces 121,122 can be provided for alignment of the sleeve 110 inside the receptacle. In this manner, it can be ensured that the sleeve 110 moves vertically downwardly, and not at an undesired angle. The support faces 121,122 can be arranged with a clearance to the sleeve 110 which is sufficiently small so that the support faces 121,122 engages the sleeve 110 if there is misalignment which is greater than a pre-determined desirable value. As illustrated in FIGS. 3 and 4, the support faces 121,122 can be located below the internal profile 103. Optionally one or both support faces 121,122 can be provided in or as part of the profile 103, or above the profile 103.

With the wellhead assembly 100 arranged as illustrated in FIG. 4, further drilling can be carried out to install well pipes in the well. These well pipes can then be cemented in place. When injecting cement between the to-be-installed well pipe and the open formation, the cement will proceed up to the bottom end 113 of the sleeve 110, from which point it will proceed substantially entirely inside the sleeve 110 up to the receptacle 102, where the cement can flow out of the cement port(s) 106 and be handled appropriately. With the wellhead assembly 100, problems with cement control due to soft soils at and immediately below the seabed 130 can be reduced or eliminated. This provides for lower cement losses and/or reduced risk of problems associated with return cement flowing out below or around the foundations 101.

With the wellhead assembly 100, the installation of the sleeve 110 into the seabed 130 and subsoil can be done in a reliable manner, compared to for example having a tail pipe or washout sleeve fixed and extending downwardly from the foundation 101 as the foundation is landed on the seabed 130. Lowering of the sleeve 110 can be carried out in a controlled manner, and supported by for example jetting or drilling immediately below the sleeve 110 as it is being lowered.

After the sleeve 110 reaches the second position, it can remain in place over the life of the associated hydrocarbon well. Continued construction and operation of the well can be done through the sleeve 110.

In any of the examples or embodiments described or claimed here, the sleeve 110 may, in the first position, extend upwardly from the receptacle 102. A majority portion of the sleeve 110 may be located above the internal profile 103 in the first position. For example, more than 50%, more than 60% or more than 70% of the longitudinal length of the sleeve 110 may be located above the internal profile 103 and/or the receptacle 102 when in the first position.

Installing the wellhead assembly 100 at the seabed 130 may comprise providing the sleeve 110 pre-installed in the foundation 101 and lowering the foundation 101 to the seabed 130 with the sleeve 110 temporarily fixed at the foundation 101. The sleeve 110 may be fixed in a first position, in which the sleeve 110 extends upwardly from the receptacle 102.

Advantageously, the foundation 101 is installed with the sleeve 110 in a position whereby the sleeve 110 remains spaced from the seabed 130 until the foundation 101 has been installed. Subsequent to installing the foundation 101, the sleeve 110 can be moved into the seabed 130.

Providing the bottom end 113 of the sleeve 110 above the seabed 130 during landing and/or installation of the foundation 101 reduces risk of operational problems during installation. The foundation 101 may, for example, be landed and installed (which may include anchoring the foundation 101 to the seabed 130, e.g. via suction buckets, piles or other means) with the bottom end 113 spaced from the seabed 130. After installation of the foundation 101, the sleeve(s) 110 may be moved (e.g., driven) into the seabed 130 in a controlled manner, for example using jetting or drilling, as described above.

Well construction equipment in the form of a sea bed removal tool, such as a drilling tool or a jetting tool, can be used to install the sleeve 110. Particularly, the sleeve 110 can be moved into the seabed 130 by driving the sea bed removal tool through the sleeve 110. The sea bed removal tool may create a bore for the sleeve 110 to be moved (i.e., lowered) into.

Advantageously, the sleeve 110 may be installed by concurrently driving the sea bed removal tool into the seabed 130 through the sleeve 110 and moving the sleeve 110 into the seabed 130. The sea bed removal tool may, for example, be positioned such that it extends through the sleeve 110 and with a drilling or jetting head at or immediately below the lower end 113, and the sleeve 110 and sea bed removal tool may be lowered together into the bore created by the sea bed removal tool. This may provide a controlled installation of the sleeve 110, with low risk of wash-out or collapse of the bore.

With the sleeve 110 installed, i.e. statically positioned in the seabed 130 and extending downward from the foundation 101, a sea bed removal tool may be driven into the seabed 130 through the sleeve 110 to produce a borehole for the well pipe 201. The sea bed removal tool may be the same sea bed removal tool as described above, or a different one. After producing the borehole for the well pipe 201, the well pipe 201 is lowered into the borehole through the sleeve 110.

The well pipe 201 may then be cemented in place inside the sleeve 110 and extend downwardly from the sleeve 110 into the seabed 130. The skilled reader will appreciate that the well pipe 201 may have a length which is considerably greater than that of the sleeve 110. The sleeve 110 may, for example, have a length of 2-10 m. The well pipe 201 may have a length which is one order of magnitude higher or more.

The well pipe 201 may have a housing at a top end part thereof, such as a conductor housing or wellhead housing, which is landed and locked in the receptacle 102. Alternatively, the sleeve 110 may comprise an internal profile for holding the well pipe housing, such that the well pipe 201 can be landed and locked in the internal profile of the sleeve 110.

The following numbered clauses outline further inventive examples and embodiments. A wellhead assembly (100) comprising:

a foundation (101) having at least one well slot (200);

the at least one well slot (200) comprising a receptacle (102) having an internal profile (103) for holding a well pipe (201);

a sleeve (110) arranged in the receptacle (102);

wherein the sleeve (110) is vertically movable and has a top end (111) which in a first position of the sleeve (110) is located above the internal profile (103) and in a second position of the sleeve (110) is located below the internal profile (103).

The wellhead assembly (100) of any preceding clause, comprising a sleeve lock mechanism (104, 120) operable to lock the sleeve (110) such as to prevent longitudinal movement of the sleeve (110) relative to the receptacle (102) when the sleeve (110) is in the second position.

The wellhead assembly (100) of any preceding clause, wherein the sleeve lock mechanism (104, 120) is arranged to automatically engage and lock the sleeve (110) relative to the receptacle (102) when the sleeve (110) reaches the second position when moved from the first position.

The wellhead assembly (100) of any preceding clause, wherein the sleeve (110) has a sleeve lock member (104) at a top end part (112) of the sleeve (110), the sleeve lock member (104) configured to engage a lock face (120) arranged below the internal profile (103) in the receptacle (102), or the receptacle (102) has a sleeve lock member arranged below the internal profile (103) in the receptacle (102) and configured to engage a lock face arranged at the top end part (112) of the sleeve (110).

The wellhead assembly (100) of any preceding clause comprising a vertical lock (105) operable to temporarily hold the sleeve (110) fixed in the first position.

The wellhead assembly (100) of any preceding clause, wherein the vertical lock (105) has an interface (105*a*) via which the vertical lock (105) can be released such as to release the sleeve (110).

The wellhead assembly (100) of any preceding clause, wherein the receptacle (102) comprises two vertically spaced support faces (121,122) for alignment of the sleeve (110).

The wellhead assembly (100) of any preceding clause, wherein the support faces (121,122) are located below the internal profile (103).

The wellhead assembly (100) of any preceding clause, wherein, in the first position, a bottom end (113) of the sleeve (110) is located inside the receptacle (102), or below the receptacle (102) and configured to be or being above a seabed (130) on which the foundation (101) is supported when the foundation (101) is in an installed position.

The wellhead assembly (100) of any preceding clause, wherein the receptacle (102) comprises at least one cement port (106) and the top end (111) in the second position of the sleeve (110) is located below the at least one cement port (106).

The wellhead assembly (100) of any preceding clause, wherein, in the first position, a majority portion of the sleeve (110) is located above the internal profile (103), for example wherein more than 50%, more than 60% or more than 70% of a length of the sleeve (110) is located above the internal profile (103).

The wellhead assembly (100) of any preceding clause, wherein the foundation (101) comprises at least two well slots (200).

The wellhead assembly (100) of any preceding clause, wherein the foundation (101) is arrange don the seabed (130) and the well pipe (201) is cemented in place inside the sleeve (110).

The wellhead assembly (100) of any preceding clause, wherein the well pipe (201) comprises a well pipe housing which is landed in and locked at the internal profile (103).

The wellhead assembly (100) of any preceding clause, wherein the well pipe (201) is a high pressure pipe.

The wellhead assembly (100) of any preceding clause, wherein a length of the sleeve (110) is less than 10 metre, for example wherein the length of the sleeve (110) is between 2 metre and 10 metre.

The wellhead assembly (100) of any preceding clause, wherein the well pipe (201) comprises a low pressure pipe having a housing landed and locked in the receptacle (102) and a high pressure pipe having a housing landed and locked in the housing of the low pressure pipe.

The wellhead assembly (100) of any preceding clause, wherein the sleeve (110) comprises an internal profile for holding a housing of the well pipe (201).

A method of installing a wellhead assembly (100) at a seabed (130), the method comprising:

positioning a foundation (101) at the seabed (130), the foundation having at least one well slot (200);

providing a sleeve (110);

bringing the sleeve (110) into the seabed (130) at the at least one well slot (200);

lowering a well pipe (201) through the sleeve (110) and into the seabed (130); and cementing the well pipe (201) in place inside the sleeve (110).

The method of any preceding clause, the method comprising driving a sea bed removal tool, such as a drilling tool or a jetting tool, into the seabed (130) through the sleeve (110).

The method of any preceding clause, the method comprising concurrently driving the sea bed removal tool into the seabed (130) through the sleeve (110), such as drilling or jetting through the sleeve (110), and moving the sleeve (110) into the seabed (130).

The method of any preceding clause, wherein the step of driving the sea bed removal tool into the seabed (130) through the sleeve (110) comprises creating a borehole for the sleeve (110), and the step of moving the sleeve (110) into the seabed (130) comprises moving the sleeve (110) into the borehole.

The method of any preceding clause, the method comprising, with the sleeve (110) statically positioned in the seabed (130), driving the sea bed removal tool into the seabed (130) through the sleeve (110) to produce a borehole for the well pipe (201), and subsequent to producing the borehole for the well pipe (201), carrying out the step of lowering the well pipe (201) through the sleeve (110) and into the seabed (130), whereby the well pipe (201) is lowered into the borehole through the sleeve (110).

The method of any preceding clause, wherein the foundation (101) comprises a receptacle (102) positioned in the at least one well slot (200), the receptacle (102) having an internal profile (103) for holding a housing of the well pipe (201), and wherein the step of bringing the sleeve (110) into the seabed (130) comprises:

moving the sleeve (110) from a first position in which the sleeve (110) is positioned in and extending upwardly from the receptacle (102) to a second position in which a top end (111) of the sleeve (110) is located below the internal profile (103).

The method of any preceding clause, wherein the step of positioning the foundation (101) at the seabed (130) comprises lowering the foundation (101) to the seabed (130) with the sleeve (110) temporarily fixed in the first position.

The method of any preceding clause, wherein sleeve (110) in the first position is spaced from the seabed (130) and the step of moving the sleeve (110) to the second position comprises moving the sleeve (110) into the seabed (130).

The method of any preceding clause, wherein the step of positioning the foundation (101) at the seabed (130) comprises landing the foundation (101) at the seabed (130) with a bottom end (113) of the sleeve (110) spaced from and located above the seabed (130), and wherein the method comprises subsequent to the step of positioning the foundation (101) at the seabed (130), moving the sleeve (110) into the seabed (130).

The method of any preceding clause, wherein, in the first position, a majority portion of the sleeve (110) is located above the internal profile (103), for example wherein more than 50%, more than 60% or more than 70% of a length of the sleeve (110) is located above the internal profile (103).

The method of any preceding clause, wherein the foundation (101) comprises at least two well slots (200).

The method of any preceding clause, comprising locking the sleeve (110) in the second position by means of a sleeve lock mechanism (104, 120).

The method of any preceding clause, wherein the well pipe (201) is a high pressure pipe.

The method of any preceding clause, wherein the well pipe (201) comprises a low pressure pipe having a low pressure pipe housing and a high pressure pipe having a high pressure pipe housing, and the method comprises:

landing and locking the low pressure pipe housing in the receptacle (102) and landing and locking the high pressure pipe housing in the low pressure pipe housing.

The method of any preceding clause, wherein the step of cementing the well pipe (201) in place inside the sleeve (110) comprises pumping cement into the well pipe (201), and leading a return cement flow through an annulus between the sleeve (110) and the well pipe (201) and out of at least one cement port (106) of the receptacle (102).

The method of any preceding clause, wherein the sleeve (110) comprises an internal profile for holding a housing of the well pipe (201), and the method comprises landing the well pipe (201) in the internal profile of the sleeve (110).

The invention claimed is:

1. A wellhead assembly comprising:

a foundation having at least one well slot, the at least one well slot comprising a receptacle having at least one cement port, a sleeve lock mechanism, and an internal profile for holding a well pipe;

a sleeve arranged in the receptacle, wherein the sleeve is vertically movable and comprises a top end which in a first position of the sleeve is located above the internal profile and in a second position of the sleeve is located below the internal profile;

a vertical lock configured to temporarily hold the sleeve fixed in the first position, wherein the vertical lock comprises a removable lock pin configured to rest against a surface of the receptacle; and two support faces arranged along a central axis of the receptacle, wherein the two support faces are configured for alignment of the sleeve within the receptacle in the second position, and the two support faces are disposed below each of the internal profile, the sleeve lock mechanism, and the at least one cement port.

2. The wellhead assembly of claim 1, wherein the sleeve lock mechanism is configured to lock the sleeve such as to prevent longitudinal movement of the sleeve relative to the receptacle when the sleeve is in the second position.

3. The wellhead assembly of claim 2, wherein the sleeve lock mechanism is arranged to automatically engage and lock the sleeve relative to the receptacle when the sleeve reaches the second position when moved from the first position.

4. The wellhead assembly of claim 1, wherein the vertical lock has an interface configured to release the vertical lock to release the sleeve.

5. The wellhead assembly of claim 1, wherein, in the first position, a bottom end of the sleeve is located inside the receptacle, or below the receptacle and above a seabed on which the foundation is supported when the foundation is in an installed position.

6. The wellhead assembly of claim 1, wherein the top end in the second position of the sleeve is located below the at least one cement port.

7. The wellhead assembly of claim 1, wherein, in the first position, a majority portion of the sleeve is located above the internal profile.

8. The wellhead assembly of claim 1, wherein the vertical lock comprises an unlock interface engageable by well construction equipment within the sleeve, wherein the vertical lock is configured to release subsequent to engagement of the unlock interface to move the sleeve in the second position.

9. The wellhead assembly of claim 1, wherein the vertical lock is disposed above the sleeve lock mechanism of the receptacle.

10. The wellhead assembly of claim 1, wherein the two support faces protrude radially inward from an inner surface of the receptacle, each of the two support faces have an inner radius less than the inner surface of the receptacle, and each of the two support faces is configured to contact the sleeve to align the sleeve at least in the second position of the sleeve.

11. The wellhead assembly of claim 1, wherein the well pipe is positioned within the sleeve in the second position, and cement is injected into the sleeve and configured to flow out of the sleeve via the at least one cement port and through an annulus between the sleeve and the well pipe.

12. A method of installing a wellhead assembly at a seabed, the method comprising:

positioning a foundation at the seabed, wherein the foundation comprises at least one well slot having a receptacle including at least one cement port, a sleeve lock mechanism, and an internal profile for holding a well pipe, wherein a sleeve is positioned in the receptacle in a first position via a vertical lock configured to temporarily hold the sleeve in the first position, and the vertical lock comprises a removable lock pin configured to rest against a surface of the receptacle;

bringing the sleeve into the seabed in a second position, wherein two support faces are arranged along a central axis of the receptacle and configured for alignment of the sleeve within the receptacle in the second position, wherein the two support faces are disposed below each of the internal profile, the sleeve lock mechanism, and the at least one cement port;

lowering the well pipe through the sleeve and into the seabed; and cementing the well pipe in place inside the sleeve.

13. The method of claim 12, further comprising concurrently driving a seabed removal tool into the seabed through the sleeve and moving the sleeve into the seabed.

14. The method of claim 12, wherein a top end of the sleeve is located below the internal profile in the second position.

15. The method of claim 12, comprising locking the sleeve in the second position via the sleeve lock mechanism.

16. The method of claim 12, wherein positioning the foundation at the seabed comprises landing the foundation at the seabed with a bottom end of the sleeve spaced from and located above the seabed, and subsequent to positioning the foundation at the seabed, moving the sleeve into the seabed.

17. The method of claim 12, wherein the vertical lock comprises an unlock interface engageable by well construction equipment within the sleeve, wherein the vertical lock is configured to release subsequent to engagement of the unlock interface to move the sleeve in the second position.

18. The method of claim 12, wherein the vertical lock is disposed above the sleeve lock mechanism of the receptacle.

19. The method of claim 12, wherein the two support faces protrude radially inward from an inner surface of the receptacle, each of the two support faces have an inner radius less than the inner surface of the receptacle, and each of the two support faces is configured to contact the sleeve to align the sleeve at least in the second position of the sleeve.

20. The method of claim 12, wherein the cementing the well pipe inside the sleeve comprises injecting cement into the sleeve, and wherein the cement is configured to flow out of the sleeve via the at least one cement port and through an annulus between the sleeve and the well pipe.

* * * * *